United States Patent [19]

Friedrich et al.

[11] 3,979,025

[45] Sept. 7, 1976

[54] DEVICES FOR HOLDING AND DISCHARGING LIQUID AND PASTE-LIKE SUBSTANCES UNDER PRESSURE

[76] Inventors: Richard Friedrich, 26 Auf Loebern, 7701 Walschingen Kreis, Constance, Germany; Frank A. E. Rindelaub, Ave. Marechal Foch, Rixensart, Belgium

[22] Filed: July 24, 1975

[21] Appl. No.: 598,785

[52] U.S. Cl. ..... 222/95

[51] Int. Cl.[2] ..... B65D 35/28

[58] Field of Search ..... 222/95, 386.5; 220/85 B

[56] References Cited

UNITED STATES PATENTS

| | | | |
|---|---|---|---|
| 2,768,638 | 10/1956 | Henke | 222/386.5 X |
| 2,815,152 | 12/1957 | Mills | 222/386.5 X |
| 3,097,766 | 7/1963 | Biehl et al. | 222/95 |
| 3,246,802 | 4/1966 | Fuhrmann | 222/95 |
| 3,323,206 | 6/1967 | Clark | 222/95 X |
| 3,731,854 | 5/1973 | Casey | 222/386.5 |

*Primary Examiner*—Allen N. Knowles
*Assistant Examiner*—Hadd Lane
*Attorney, Agent, or Firm*—Francis N. Carten

[57] ABSTRACT

Dual-chamber pressurized dispensers for a variety of products. A flexible inner container defines one chamber in which the product to be dispensed is contained, the inner container being connected at one end to a dispensing valve. A rigid outer container encloses the flexible inner container and therebetween defines another chamber in which a pressurizing propellant is contained. Each inner container is designed to achieve high expulsion efficiency, with an upper portion having a lipped aperture in which the dispensing valve is received and a lower portion having longitudinal stiffening ribs.

28 Claims, 6 Drawing Figures

DEVICES FOR HOLDING AND DISCHARGING LIQUID AND PASTE-LIKE SUBSTANCES UNDER PRESSURE

BACKGROUND OF THE INVENTION

Prior-art pressurized dispensers include both single-chamber and dual-chamber types. In the dual-chamber dispensers known in the art, serious problems involving the manner of collapse of the inner containers have been encountered. Specifically, many of these known inner containers are prone to forming pockets in which the product to be dispensed is trapped. This trapped product cannot be expelled from the inner container and is therefore wasted.

A number of approaches have been employed in attempting to solve the problem of product entrapment in the inner container of dual-chamber pressurized dispensers. For example, spreader rings or frames have been disposed within the inner container to control the manner of its collapse and thereby make it predictably free of pockets of entrapped product. However, this approach adds additional structural elements to the dispenser, thereby increasing the complexity and cost of manufacture. In addition, the spreader rings and frames can cause rupture of the inner container in the regions of contact therewith as the inner container collapses and discharges the product container therein. Also, relatively high propellant pressures are necessary to collapse such inner containers.

Another approach to the problem of product entrapment is to form the inner container with either vertical or horizontal pleats. The inner containers having vertical pleats are of an extremely complex geometry and are difficult to form by existing techiques. In addition, the sharp edges of the pleats cause high localized stresses, particularly when the inner container is formed of metal. These stresses frequently cause cracking and rupture of the inner container, resulting in spillage of the product from its chamber into the propellant chamber and consequent disabling of the dispensing device. The inner containers having horizontal pleats suffer from all of these disadvantages, and in addition cannot be reduced in diameter for insertion through the small opening at the top of the outer container.

SUMMARY OF THE INVENTION

The present invention is embodied in and carried out by dual-chamber pressurized dispensers for products having a wide range of viscosities, in which dispensers the inner containers are formed with longitudinal stiffening ribs to prevent the formation of pockets in which the contained product might be entrapped during collapse of the inner container.

BRIEF DESCRIPTION OF THE DRAWINGS

The present invention may be better understood by reading the written description thereof with reference to the drawings, of which.

DETAILED DESCRIPTION OF THE PREFERRED EMBODIMENTS

Figure 1:
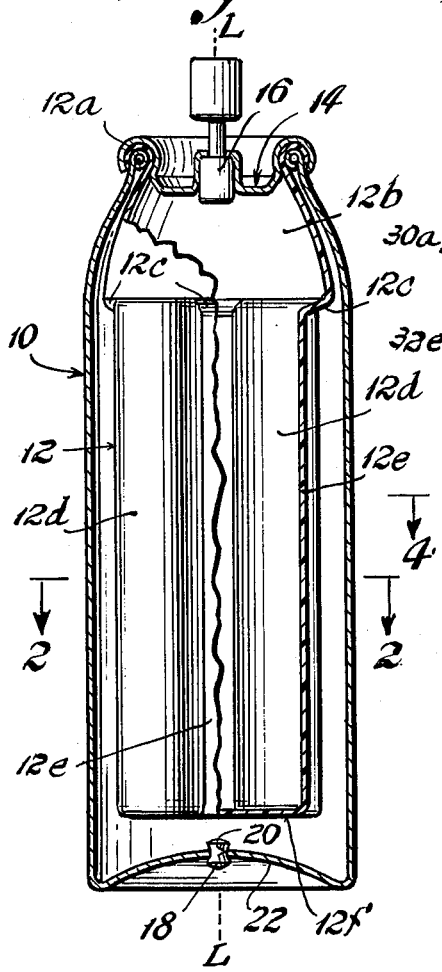
FIG. 1 is a side view of a first dual-chamber pressurized dispenser with the outer container broken away to reveal the configuration of a first inner container.
Figure 2:
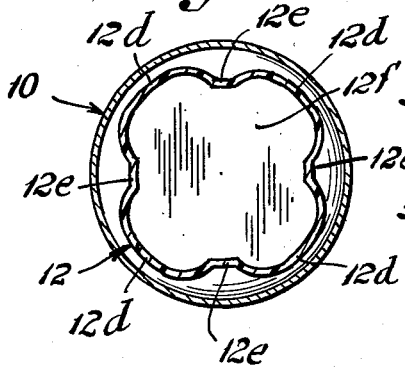
FIG. 2 is sectional view of the dual-chamber dispenser of FIG. 1 taken along line 2—2.

Referring to the first embodiment shown in FIGS. 1 and 2, a rigid outer container 10 encloses a flexible inner container 12, these two containers being joined at their respective openings by a retaining cap 14 the periphery of which is crimped around the lip of the inner container 12 which overlaps the inwardly curled periphery defining the opening in the outer container 10. A dispensing valve 16 is secured within the retaining cap 14 to enable controlled dispensing of the product held in the inner container 12. A plug 18 is inserted in the aperture 20 in the dished bottom 22 of the outer container 10 after the pressurizing propellant gas has been introduced through the aperture 20 into the chamber defined between inner and outer containers 12 and 10, respectively. The flexible inner container 12 may be made of any suitable metal or plastic, or of a combination of such materials. The preferred metal is aluminum, which may have a coating of plastic on its interior to prevent chemical interaction between certain products and the metal inner container. A number of plastics are suitable for forming the inner container, for example, polyethylene, polypropylene, nylon, and PERLON. The configuration of the inner container 12, starting at its open upper end, is defined by a flared lip **12*a* which extends radially outwardly from the opening centered around longitudinal axis L—L, a domed upper portion 12*b* depending therefrom, a truncated conical section 12*c* which is intersected by both the stiffening ribs 12*d* and the intermediate linking sections 12*e* between the stiffening ribs 12*d*, and a closed bottom end 12*f*. As is readily perceived from FIG. 2, in cross-section the intermediate linking sections 12*e* appear as small cusps or arcuate segments of a circle, and the stiffening ribs 12*d*** appear as large, flattened cusps.

In operation, when the valve 16 is actuated, fluid communication is established between the chamber defined by the inner container 12 for holding the product and the ambient atmosphere. The pressurizing propellant, which is preferably nitrogen but may be any one of a number of known gases or mixtures thereof including air, exerts uniform pressure over the surface of the inner container 12. However, the design of the inner container is such that the intermediate linking segments **12*e* will respond first to the pressure of the propellant when valve 16 is actuated. As the intermediate linking segments 12*e* move radially inward, random collapse of the inner container is prevented by the stiffening action of the ribs 12*d*. Although at first glance it might appear that when the intermediate linking sections 12*e* move in close to the longitudinal axis the opposed edges of the stiffening ribs might contact one another to form pockets in which the product is trapped, this cannot occur because of the communication of the channels formed by the inner surfaces of the ribs 12*d* through the truncated conical section 12*c* with the domed portion 12*b* of the inner container 12 to make certain that the product which may be enclosed by the folding of the stiffening ribs 12*d* is expelled. As collapsing of the inner container 12 progresses further, the closed bottom end 12***f* of the inner container 12 is drawn upward and the stiffening ribs 12*d* and intermediate linking sections 12*e* become skewed with respect to the longitudinal axis L—L. Finally, the dependant portion of the inner container is drawn upward into the domed portion 12*b*.

Figure 3:
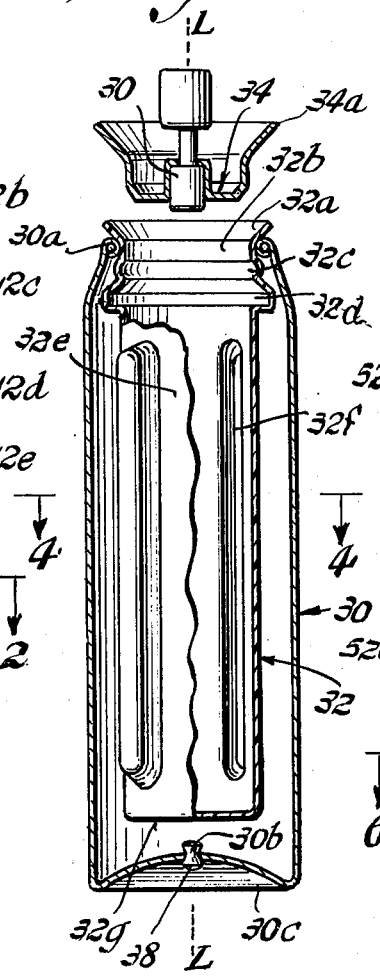
FIG. 3 is a side view of a second dual-chamber pressurized dispenser with the outer container broken away to reveal the configuration of a second inner container.
Figure 4:
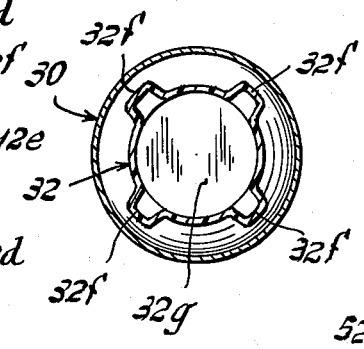
FIG. 4 is a sectional view of the dual-chamber dispenser of FIG. 3 taken along line 4—4.

With regard to the second embodiment shown in the partially-exploded view of FIG. 3 and the sectional view of FIG. 4, this dual-chamber pressurized dispenser also consists of a rigid outer container 30 which encloses a flexible inner container 32 of generally cylindrical configuration and is joined thereto by retaining cap 34, shown here in FIG. 3 separated from the other elements of the combination. A dispensing valve 36 is secured within the retaining cap 34. The open end of the inner container 32 has a flared lip 32*a* for overlapping the inwardly-curled periphery 30*a* defining the opening in the upper end of the outer container 30, with a dependant collar portion 32*b* against which the periphery 30*a* abuts. A beaded portion 32*c* is dependant from collar portion 32*b* and extends to a collar portion 32*d* which provides radial stiffening of the inner container 32 so that it does not collapse in the region of the valve 36 and thereby prevent fluid communication with the valve intake. A generally cylindrical lower portion 32*e* is dependant from the radially-extended collar portion 32*d*. Relatively narrow stiffening ribs 32*f* protrude radially outward parallel to the longitudinal axis L—L. As shown in FIG. 3, the stiffening ribs 32*f* may have varying degrees of fairing into the generally cylindrical portion 32*e* of the inner container 32; at the lower end of the ribs 32*f*, the fairing is more gradual than at the upper end. The generally cylindrical portion 32*e* has a closed bottom end 32*g*. A plug 38 is inserted in the aperture 30*b* in the dished bottom 30*c* of the outer container 30 after the pressurizing propellant gas has been introduced through the aperture 30*b* into the chamber defined between inner and outer containers 32 and 30, respectively. The pressurizing propellant is preferably nitrogen, but may be any one of a number of known gases or mixtures of gases. The flexible inner container 32 may be made of any of the materials or combinations of materials described in connection with the first embodiment.

In the manufacturing process, retaining cap 34 is lowered into the concentric openings of the inner and outer containers and its peripheral portion 34*a* is crimped over the flared lip 32*a* to compress same against the inwardly-curled periphery 30*a* of outer container 30. The flared lip 32*a* in this embodiment and the corresponding flared lips in the other disclosed embodiments do not need to be tapered to a feather edge and overlaid by a separate gasket element disposed between the lip 32*a* and the crimped peripheral portion 34*a* of retaining member 34. The combined flared lip 32*a*, collar portion 32*b*, and beaded portion 32*c* form an annular groove in which the inwardly-curled periphery 30*a* defining the opening in outer container 30 may fit. The beaded portion 32*c* also spaces the radially-extended collar portion 32*d* away from the narrowed upper end of outer container 30, thereby preventing mechanical contact or interference with the tapered inner surface of the outer container 30.

In operation, the completed dual-chamber pressurized dispenser operates in a manner similar to the first embodiment. The segments of the cylindrical portion 32*e* which lie between the stiffening ribs 32*f* respond first to the pressure of the propellant when valve 36 is actuated. As these segments of the generally cylindrical portion 32*e* move radially inwardly toward the longitudinal axis L—L, the inner container 32 collapses in a controlled, predictable manner so as to prevent the formation of pockets in which the enclosed product might be trapped. The sharp fairing of the ribs 32*f* into the generally cylindrical portion 32*e* at the top of the ribs prevents complete closure of the channel defined by the ribs 32*f*, so that whatever product may be in these channels can be expelled through an opening at the top of each rib as the inner edges of the rib close toward each other during collapse of the inner container 32. The cross-section of the inner channels defined by the stiffening ribs 32*f* is best shown in FIG. 4. Eventually, the generally cylindrical portion 32*e* will become twisted about the longitudinal axis L—L so that the ribs 32*f* are skewed with respect to that axis.

Figure 5:
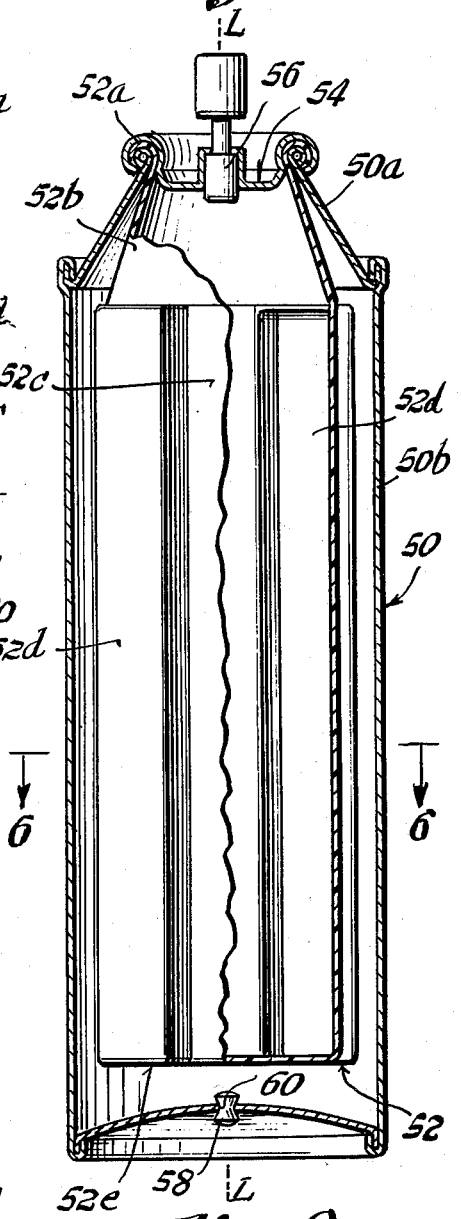
FIG. 5 is a side view of a third dual-chamber pressurized dispenser with the outer container broken away to reveal the configuration of a third inner container.
Figure 6:
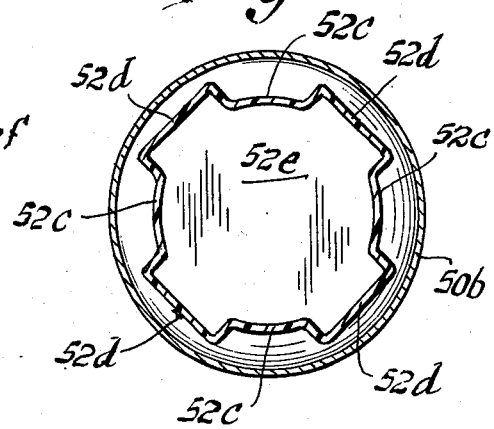
FIG. 6 is a sectional view of the dual-chamber pressurized dispenser of FIG. 5 taken along line 6—6.

Referring now specifically to the third embodiment shown in FIGS. 5 and 6, the dual-chamber pressurized dispenser depicted there includes a rigid outer container 50 which has an upper portion 50*a* in the form of a truncated cone having a small opening formed by an outwardly-curled periphery at its upper end and a large opening formed at its lower periphery; a cylindrical portion 50*b* connected to the larger, bottom opening of truncated conical section 50*a* by welding, brazing or any other suitable process; and a dished bottom portion 50*c* connected to the lower end of cylindrical portion 50*b* by a suitable process of the type mentioned above. A flexible inner container 52 is joined to the rigid outer container 50 by a retaining cap 54 in the manner described in connection with the first and second embodiments. A dispensing valve 56 is secured within the retaining cap 54. A plug 58 is inserted in the aperture 60 in the dished bottom 50*c* of the outer container 50 after the pressurizing propellant gas has been introduced through the aperture 60 into the chamber defined between inner and outer containers 52 and 50, respectively. The flexible inner container 52 may be made of any suitable material or combination of materials as described in connection with the first and second embodiments. The configuration of the inner container 52, starting at its upper end, is defined by a flared lip 52*a* which extends radially outwardly from the opening centered around longitudinal axis L—L, a truncated conical section 52*b* depending from the flared lip 52*a*, curved segments 52*c* depending from the truncated conical section 52*b* to connect longitudinal stiffening ribs 52*d*, and a closed bottom end 52*e*. As shown by FIG. 6, in cross-section the stiffening ribs 52*d* have radially-extending side-walls and substantially flat outer walls, and the curved segments 52*c* appear as cusps or arcuate segments of a circle.

In operation, the dual-chamber pressurized dispenser shown in FIGS. 5 and 6 operates in a manner similar to the first and second embodiments. The curved segments 52*c* which lie between the stiffening ribs 52*d* respond first to the pressure of the propellant when valve 56 is actuated. As these curved segments 52*c* move radially inward toward the longitudinal axis L—L, the inner container 52 collapses without forming pockets in which the product to be dispensed can be trapped. Because the stiffening ribs 52*d* extend all the way to the top of the generally cylindrical portion of the inner container 52, being closed there by flat end walls, there is an enhanced rigidity in the region of the junction of the stiffening ribs 52*d* and the larger opening in the truncated conical section 50*a*. Consequently, as the inner edges of the side-walls of each of the ribs 52*d* approach one another during collapse of the inner container 52, the channels defined by the ribs 52*d* will be maintained open at the upper end so that fluid communication is maintained through the truncated conical section 52*b* to the intake of valve 56. Eventually, the major portion of the inner container 52 defined by the curved segments 52*c* and longitudinal stiffening ribs 52*d* will become twisted about the longitudinal axis L—L so that the ribs 52*d* and the curved segments 52*c* are skewed with respect to that axis.

The disclosed inner containers eliminate the problem of corrosion caused by contact between the product to be expelled and a single metal container. The known approach to this corrosion problem in single-chamber dispensers is to coat the interior of the container with lacquer. Applicants' invention eliminates the need for this step in the manufacturing process. Also, previously-encountered problems of corrosion between inner and outer containers made of different metals is eliminated where a plastic inner container is employed. The preferred plastic is low-density polyethylene. The use of a plastic inner container with a lipped opening also prevents potentially corrosive metal-to-metal contact between the retaining cap and the outer container. Applicants' inner containers are of substantially uniform thickness, but may be made of varying thickness in the reegion of the flared lip to enable it to better withstand the pressures of crimping, or in the region of the tapered upper portion to strengthen it against premature collapse or in any other portion of the inner containers to vary their collapsing characteristics. The disclosed inner containers can readily be made sterile by known techniques and are air-tight in assembly with the other components of the disclosed dual-chamber pressurized dispensers. The disclosed dispensers work equally well in any spatial orientation, unlike dispensers of the single-chamber type. As previously mentioned, the pressurizing propellant gas may be any one of a number of known gases or combinations of such gases, including compressed air, hydrocarbons, and fluorocarbons. However, nitrogen is the preferred propellant because of its high molecular weight which minimizes transmigration through the plastic inner containers. Also, nitrogen will not react with the great majority of products to be dispensed from the plastic inner containers, and is relatively inexpensive. Since the nitrogen need not be liquefied, there is no refrigeration effect such as occurs when liquefied propellants change to the gaseous state.

The outer containers for the disclosed dispensers are preferably formed by a high-speed seam-welding body maker, for example, one carrying out the Soudronic welding process. The first and second disclosed embodiments employ a monobloc outer container, preferably made of aluminum. These outer containers can withstand a maximum pressure of 18 bar (ATU). The third embodiment employs an outer container formed of several discrete metal sections welded or brazed together, as previously described.

All conventional valves including spray, paste, or tilt valves can be utilized without a syphon tube. Filling of the inner container is carried out through the opening in the inner container before the emplacement and crimping of the retaining cap. Propellant charging may be carried out by known machines, which have varying capacities up to 500 cans per minute. Initial and final propellant pressures are directly related to the total inner volume of the outer container and to the gas volume. The required pressures are also dependant on the viscosity of the product to be dispensed: the higher the viscosity of the product, the more gas volume is necessary. The disclosed dispensers provide a relatively high ratio of product volume to propellant volume, regardless of the product to be dispensed. Also, a very high percentage (nearly 100%) of the contained product is actually expellable, particularly where the inner container is formed of a very flexible plastic. The amount of useful product (a percentage of the total product contained) is a function of product viscosity and propellant pressure. The disclosed dispensers permanently retain their propellant, thereby preventing the release of this gas into the atmosphere and contributing to their long shelf life. Also, at least the inner and outer containers are reusable.

The advantages of the present invention, as well as certain changes and modification to the disclosed embodiments thereof, will be readily apparent to those skilled in the art. It is applicants' intention to cover all those changes and modifications which could be made to the embodiments of the invention herein chosen for the purposes of the disclosure without departing from the spirit and scope of the invention.

What we claim is:

1. In a dual-chamber pressurized dispenser comprising an outer container having an opening; an inner container disposed within said outer container and having an opening; a retaining member connecting said outer and inner containers at their respective openings; a dispensing valve secured in the opening of said inner container by said retaining member; and a predetermined quantity of pressurizing propellant between said inner and outer containers, the improvement comprising: a plurality of hollow, product-containing longitudinal stiffening rib means formed in said inner container and operative to prevent the formation of pockets of entrapped product during the collapsing of said inner container radially inwardly toward its longitudinal axis.

2. A dual-chamber pressurized dispenser according to claim 1, wherein said inner container is formed of metal and has a chemically inert interior coating.

3. A dual-chamber pressurized dispenser according to claim 1, wherein said inner container comprises a tapered portion in which said opening is formed, and a flared lip which is compressed between said retaining member and said outer container.

4. A dual-chamber pressurized dispenser according to claim 3, wherein said inner container comprises a truncated conical portion dependant from said tapered portion, each of said longitudinal stiffening rib means being dependent from said truncated conical portion and joined by intermediate linking sections to form an extended lower portion having a closed end.

5. A dual-chamber pressurized dispenser according to claim 3, wherein said inner container comprises a generally cylindrical portion dependant from said tapered portion and having a closed end, each of said longitudinal stiffening rib means extending over the length of said generally cylindrical portion.

6. A dual-chamber pressurized dispenser according to claim 5, wherein each of said longitudinal stiffening rib means has first and second opposed side walls extending radially outwardly from said generally cylindrical portion, a substantially flat outer wall connecting said opposed side walls, and first and second opposed end walls connecting said opposed side walls and said outer wall.

7. A dual-chamber pressurized dispenser according to claim 3, wherein said tapered portion is in the form of a truncated dome.

8. A dual-chamber pressurized dispenser according to claim 3, wherein said tapered portion is in the form of a truncated cone.

9. A dual-chamber pressurized dispenser according to claim 1, wherein said inner container comprises a radially-extended collar portion for stiffening said inner container in the region of said opening.

10. A dual-chamber pressurized dispenser according to claim 9, wherein said inner container comprises a flared lip which is compressed between said retaining member and said outer container, a first collar portion dependant from said flared lip, a beaded portion dependant from said first collar portion, said radially-extended collar portion being dependant from said beaded portion, and a generally cylindrical portion in which each of said longitudinal stiffening rib means is formed dependant from said radially-extended collar portion and having a closed end.

11. A dual-chamber pressurized dispenser according to claim 9, wherein each of said longitudinal stiffening rib means is relatively narrow in comparison with the intermediate linking segments of said generally cylindrical portion.

12. A dual-chamber pressurized dispenser according to claim 11, wherein each of said longitudinal stiffening rib means extends over less than the entire length of said generally cylindrical portion.

13. A dual-chamber pressurized dispenser according to claim 11, wherein each of said longitudinal stiffening rib means is gradually faired into said generally cylindrical portion near its closed end and sharply faired into said generally cylindrical portion near said opening in said inner container.

14. A dual-chamber pressurized dispenser according to claim 1, wherein said inner container is formed of a plastic selected from the group consisting of polyethylene, polypropylene, nylon and PERLON.

15. An inner container for a dual-chamber pressurized dispenser comprising an upper portion having an opening therein, and a lower portion having a closed end and a plurality of hollow, product-containing longitudinal stiffening rib means operative to prevent the formation of pockets of entrapped product during the collapsing of said inner container radially inwardly toward its longitudinal axis.

16. An inner container according to claim 15, wherein said upper portion is tapered and has a flared lip extending about said opening.

17. An inner container according to claim 16, comprising a truncated conical portion dependant from said tapered upper portion, each of said longitudinal stiffening rib means being dependant from said truncated conical portion and joined by intermediate linking sections.

18. An inner container according to claim 16, wherein each of said longitudinal stiffening rib means extends over the length of said lower portion and said plurality of longitudinal stiffening rib means is interconnected by curved segments.

19. An inner container according to claim 18, wherein each of said longitudinal stiffening rib means has first and second opposed side walls extending radially outward from said curved segments, a substantially flat outer wall converting said opposed side walls, and first and second opposed end walls connecting said opposed side walls and said outer wall.

20. An inner container according to claim 16, wherein said tapered upper portion is in the form of a truncated dome.

21. An inner container according to claim 16, wherein said tapered upper portion is in the form of a truncated cone.

22. An inner container according to claim 15, comprising a radially-extended collar portion for stiffening said inner container in the region of said opening.

23. An inner container according to claim 22, comprising a flared lip, a first collar portion dependant from said flared lip, a beaded portion dependent from said collar portion, said radially-extended collar portion being dependant from said beaded portion, said lower portion being generally cylindrical and dependant from said radially-extended collar portion.

24. An inner container according to claim 23, wherein each of said longitudinal stiffening rib means is relatively narrow in comparison with the intermediate areas of said generally cylindrical lower portion.

25. An inner container according to claim 24, wherein each of said longitudinal stiffening rib means extends over less than the entire length of said generally cylindrical lower portion.

26. An inner container according to claim 25, wherein each of said longitudinal stiffening rib means is gradually faired into said generally cylindrical lower portion near said closed end and are sharply faired into said generally cylindrical lower portion near said opening.

27. An inner container according to claim 15, wherein said inner container is formed of metal and has a chemically inert interior coating.

28. An inner container according to claim 15, wherein said inner container is formed of a plastic selected from the group consisting of polyethylene, polypropylene, nylon and PERLON.

* * * * *

UNITED STATES PATENT AND TRADEMARK OFFICE

CERTIFICATE OF CORRECTION

PATENT NO. : 3,979,025

DATED : September 7, 1976

INVENTOR(S) : Richard Friedrich and Frank A. E. Rindelaub

It is certified that error appears in the above-identified patent and that said Letters Patent are hereby corrected as shown below:

Column 1, line 68, the colon ":" should be changed to a semicolon --;--.

Column 5, line 30, "reegion" should be changed to --region--.

Column 6, line 21, "modification" should be changed to --modifications--; line 55, "dependent" should be changed to --dependant--.

Column 8, line 16, "converting" should be changed to --connecting--; line 46, "are" should be changed to --is--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*